US008329615B2

(12) United States Patent
Muro et al.

(10) Patent No.: US 8,329,615 B2
(45) Date of Patent: Dec. 11, 2012

(54) IMAGE FORMATION METHOD USING THERMAL TRANSFER SHEET AND THERMAL TRANSFER IMAGE-RECEIVING SHEET

(75) Inventors: Naotsugu Muro, Haibara-gun (JP); Takuya Arai, Minami-ashigara (JP); Masaaki Miki, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 416 days.

(21) Appl. No.: 12/749,171

(22) Filed: Mar. 29, 2010

(65) Prior Publication Data

US 2010/0243141 A1 Sep. 30, 2010

(30) Foreign Application Priority Data

Mar. 30, 2009 (JP) ..... 2009-082098

(51) Int. Cl.
*B41M 5/382* (2006.01)
*B41M 5/50* (2006.01)

(52) U.S. Cl. ..... 503/227; 156/235

(58) Field of Classification Search ..... None
See application file for complete search history.

(56) References Cited

U.S. PATENT DOCUMENTS 4,737,486 A 4/1988 Henzel
5,420,095 A 5/1995 Bodem et al.
5,962,369 A * 10/1999 Oldfield et al. ..... 503/227
7,485,402 B2 2/2009 Arai et al.

FOREIGN PATENT DOCUMENTS

JP 63-135288 A 6/1988
JP 8-175036 A 7/1996
JP 2002-274064 A 9/2002
JP 2008-006781 A 1/2008
JP 2008-272948 A 11/2008

OTHER PUBLICATIONS

Office Action dated Aug. 14, 2012 in Japanese Application No. JP 2009-082098 partial English-language translation.

* cited by examiner

*Primary Examiner* — Bruce H Hess
(74) *Attorney, Agent, or Firm* — Sughrue Mion, PLLC

(57) ABSTRACT

A method of image formation comprising putting a thermal transfer sheet and a thermal transfer image-receiving sheet one upon another wherein the thermal transfer sheet has on a substrate film a subbing layer of a titanium oxide film, the dye layer on a part of the subbing layer and a transferable protective layer laminate on the other part of the subbing layer than the part for the dye layer thereon, and wherein the thermal transfer image-receiving sheet has on a support the receiving layer containing a polymer latex, in which vinyl chloride is polymerized in at least 95 mol % of all the polymerization monomers, and a polyether-modified silicone, and a heat-insulating layer; recording an image on the receiving layer by a heating device; and transferring at least a part of the transferable protective layer laminate onto the receiving layer by the heating device.

20 Claims, No Drawings

IMAGE FORMATION METHOD USING THERMAL TRANSFER SHEET AND THERMAL TRANSFER IMAGE-RECEIVING SHEET

CROSS-REFERENCE TO RELATED APPLICATIONS

The present application claims the benefit of priority from Japanese Patent Application No. 2009-082098, filed on Mar. 30, 2009, the contents of which are herein incorporated by reference in their entirety.

BACKGROUND OF THE INVENTION

1. Field of the Invention

The present invention relates to an image formation method, more concretely to an image formation method using a thermal transfer sheet and a thermal transfer image-receiving sheet.

2. Description of the Related Art

Heretofore, various thermal transfer recording methods are known. Above all, a dye diffusion transfer recording system is specifically noted as a process capable of producing color hard copies of which the image quality is the nearest to that of silver salt photographs. Moreover, as compared with silver salt photographs, the system has other various advantages in that it is a dry system, it can produce visible images directly from digital data, and it is simple in image duplication.

In the dye diffusion transfer recording system, a dye (or colorant)-containing thermal transfer sheet (hereinafter referred to as "ink sheet") and a thermal transfer image-receiving sheet (hereinafter referred to as "image-receiving sheet") are put one upon another, and the thermal transfer sheet is heated with a heating element such as thermal head from which the heat generation is controlled by electric signals given thereto, whereby the colorant in the thermal transfer sheet is transferred onto the thermal transfer image-receiving sheet for image information recording thereon. In this, three colors of cyan, magenta and yellow, or four colors of these and black are recorded as superimposed, thereby giving a color image having a continuously changing color density in a mode of transfer recording. Simultaneously with transfer recording of color images, a transferable protective layer laminate (hereinafter referred to as "OP layer") may be transferred onto the thermal transfer image-receiving sheet to protect the outputted images.

With the recent development of digital imaging technology by computer, the quality of recorded images is bettered and the market of the dye diffusion transfer recording system is expanding, and with that, the print system installation environment is being diversified.

On the other hand, JP-A 2008-6781 discloses a thermal transfer image-receiving sheet in which the receiving layer contains a polymer containing a vinyl chloride-derived recurring unit in some degree, gelatin and a reactive group-having silicone compound and in which the gelatin is hardened with a specific hardener.

JP-A 63-135288 discloses a thermal transfer sheet having a subbing layer that comprises a polymer having an inorganic main chain of an oxide of a Group IVa or IVb element, and a dye layer.

The present inventors have investigated the prior art technology, and have known that the image outputted on the image-receiving sheet of JP-A 2008-6781 in a high-humidity environment is unsatisfactory in point of the transfer density thereof.

The image formation system of transferring the dye from a dye layer onto an image-receiving sheet followed by transferring a transferable protective layer laminate thereon to complete the outputted image is problematic in that the gloss of the image is often uneven when the image is outputted in a high-humidity environment.

SUMMARY OF THE INVENTION

An object of the invention is to provide an image formation method using a thermal transfer sheet and a thermal transfer image-receiving sheet, in which the outputted image has a high transfer density even in a high-humidity environment and in which the transferable protective layer laminate transferred onto the image-receiving sheet has excellent uniformity.

The present inventors have assiduously studied and, as a result, have found that the above-mentioned objects can be attained by the following means.

[1] A method of image formation comprising:

putting a thermal transfer sheet and a thermal transfer image-receiving sheet one upon another in such a manner that a dye layer of the thermal transfer sheet is kept in contact with a receiving layer of the thermal transfer image-receiving sheet, wherein the thermal transfer sheet has at least one subbing layer of a titanium oxide film on a substrate film, having the dye layer on a part of the subbing layer and having a transferable protective layer laminate on the other part of the subbing layer than the part for the dye layer thereon, and wherein the thermal transfer image-receiving sheet has, on a support, at least one receiving layer containing a polymer latex, in which vinyl chloride is polymerized in at least 95 mol % of all the polymerization monomers, and a polyether-modified silicone, and having at least one heat-insulating layer;

recording an image on the receiving layer by a heating device; and transferring at least a part of the transferable protective layer laminate onto the receiving layer by the heating device.

[2] The method of image formation of [1], wherein the polymer latex in which vinyl chloride is polymerized in at least 95 mol % of all the polymerization monomers is a copolymer latex of vinyl chloride and at least one monomer selected from vinyl acetate, acrylic acid, acrylates, methacrylic acid and methacrylates, or a vinyl chloride homopolymer latex.

[3] The method of image formation of [1] or [2], wherein the titanium oxide film is a polycondensation product of a titanium alkoxide or its hydrolyzate.

The advantage of the invention is that, in outputting images in a high-humidity environment, the transfer density is high and the gloss unevenness (referred to as "OP unevenness") of the transferred protective layer laminate is extremely low.

BEST MODE FOR CARRYING OUT THE INVENTION

The invention is described in detail hereinunder. In this description, the numerical range expressed by the wording "a number to another number" means the range that falls between the former number indicating the lowermost limit of the range and the latter number indicating the uppermost limit thereof.

The image formation method of the invention comprises putting a thermal transfer sheet having at least one subbing layer of a titanium oxide film on a substrate film, having a dye layer on a part of the subbing layer and having a transferable protective layer laminate on the other part of the subbing layer than the part for the dye layer thereon, and a thermal transfer image-receiving sheet having, on a support, at least one receiving layer containing a polymer latex, in which vinyl chloride accounts for at least 95 mol % of all the polymerization monomers, and a polyether-modified silicone, and having at least one heat-insulating layer, one upon another in such a manner that the dye layer of the thermal transfer sheet is kept in contact with the receiving layer of the thermal transfer image-receiving sheet, then recording an image on the receiving layer by a heating device, and further transferring the transferable protective layer laminate onto the receiving layer by the heating device. The thermal transfer image-receiving sheet and the thermal transfer sheet for use in the image formation method of the invention are described below, and then the image formation method of the invention is described.

[Thermal Transfer Image-Receiving Sheet]

The thermal transfer image-receiving sheet for use in the invention has, on a support, at least one receiving layer (dye-receiving layer) containing a polymer latex, in which vinyl chloride accounts for at least 95 mol % of all the polymerization monomers, and a polyether-modified silicone, and has at least one heat-insulating layer (porous layer). Preferably, the sheet has at least one heat-insulating layer between the support and the receiving layer. In addition, the sheet may have interlayers with, given thereto, various functions of, for example, white background regulation, static charge prevention, adhesiveness, leveling or the like, between the support and the receiving layer. If desired, a release layer may be formed on the outermost layer of the sheet that is placed on a transfer sheet.

In the invention, the receiving layer, the heat-insulating layer and at least one interlayer are formed in a mode of water-based coating. The layers may be formed in an ordinary coating method of roll coating, bar coating, gravure coating, gravure reverse coating, die coating, slide coating, curtain coating or the like. The receiving layer, the heat-insulating layer and the interlayers may be formed in separate coating, or any of these may be formed at the same time by a simultaneous multilayer coating method. In the invention, preferably, at least one receiving layer and at least one heat-insulating layer are formed by the simultaneous multilayer coating method for more effectively attaining the effect of the invention.

On the other side of the support opposite to the side thereof coated with the receiving layer, a curling preventing layer, a writing layer and an antistatic layer may be provided.

<Support>

The support for the thermal transfer image-receiving sheet for use in the invention may be any conventional known one. Preferred is a waterproof support. When a waterproof support is used, water penetration into the support may be prevented, and therefore the receiving layer can be protected from degradation with time. The waterproof support includes, for example, coated paper, laminate paper, synthetic paper. Above all, preferred is laminate paper.

<Receiving Layer>

The receiving layer of the thermal transfer image-receiving sheet for use in the invention has at least one receiving layer containing a polymer latex, in which vinyl chloride accounts for at least 95 mol % of all the polymerization monomers, and a polyether-modified silicone.

(Vinyl Chloride-Based Polymer Latex)

The receiving layer contains a polymer latex, in which vinyl chloride accounts for at least 95 mol % of all the polymerization monomers. (Hereinafter the polymer latex, in which vinyl chloride accounts for at least 95 mol % of all the polymerization monomers, may be referred to as a vinyl chloride-based polymer latex.) The vinyl chloride-based polymer latex receives the dye (colorant) transferred from a thermal transfer sheet.

The polymer latex is a dispersion of a water-insoluble hydrophobic polymer dispersed in a water-soluble dispersant as fine particles therein. Regarding the dispersion state of the vinyl chloride-based polymer latex for use in the invention, the polymer may be emulsified in a dispersion medium, or may be formed through emulsion polymerization, or may be dispersed as micelles, or the polymer molecule may partly have a hydrophilic structure and the molecular chain itself of the polymer may be in molecular dispersion.

Preferably, the mean particle size of the dispersion particles of the vinyl chloride-based polymer latex is from 10 to 1000 nm, more preferably from 30 to 300 nm.

In the vinyl chloride-based polymer latex for use in the invention, vinyl chloride accounts for at least 95 mol % of all the polymerization monomers, preferably at least 97 mol %, even more preferably at least 99 mol %. Using the vinyl chloride-based polymer latex in which vinyl chloride accounts for at least 95 mol % of all the polymerization monomers is preferred from the viewpoint of enhancing the peelability of the thermal transfer image-receiving sheet from a thermal transfer sheet.

The vinyl chloride-based polymer latex for use in the invention may be copolymerized with any other comonomer than vinyl chloride so far as it comprises at least vinyl chloride as the monomer to give the polymer. The other comonomer than vinyl chloride is preferably vinyl acetate, acrylic acid, acrylate, methacrylic acid or methacrylate. The alcohol moiety in the ester moiety of the acrylate or methacrylate is preferably an aliphatic alcohol, preferably having from 1 to 10 carbon atoms, more preferably from 1 to 8 carbon atoms, even more preferably from 2 to 6 carbon atoms, most preferably 4 carbon atoms.

The vinyl chloride-based polymer latex for use in the invention is preferably a copolymer latex with a comonomer selected from vinyl acetate, acrylic acid, acrylate, methacrylic acid and methacrylate, or a vinyl chloride homopolymer latex, from the viewpoint of increasing the transfer density as high as possible.

Concretely, the vinyl chloride-based polymer latex for use in the invention includes vinyl chloride/vinyl acetate copolymer, vinyl chloride/acrylate copolymer, vinyl chloride/methacrylate copolymer, vinyl chloride/vinyl acetate/acrylate copolymer, vinyl chloride/acrylate/ethylene copolymer, etc.; however, the invention should not be restricted by these examples. The copolymer may be a binary copolymer or a ternary or more polynary copolymer, in which the monomers may be distributed irregularly or may be block-copolymerized.

In case where the vinyl chloride-based polymer latex is a copolymer, the copolymer may contain any auxiliary monomer ingredient of vinyl alcohol derivatives, maleic acid derivatives, vinyl ether derivatives, etc.

In the invention, the glass transition temperature (hereinafter referred to as "Tg") of the vinyl chloride-based polymer latex for use in the invention is preferably from −30° C. to 100° C., more preferably from 0° C. to 90° C., even more preferably from 20° C. to 90° C., still more preferably from 40° C. to 90° C.

In case where the glass transition temperature (Tg) could not be measured, it may be computed according to the following formula:

$$1/Tg=\Sigma(Xi/Tgi)$$

In this, the polymer is considered to be formed through copolymerization of n's monomers of from i=1 to n. Xi means the mass fraction of the i'th monomer ($\Sigma Xi^{o}=1$); and Tgi means the glass transition temperature (absolute temperature) of the homopolymer of i'th monomer. Σ is the sum of i=1 to n. For the glass transition temperature (Tgi) of the homopolymer of each monomer, the data shown in "Polymer Handbook (3rd Edition)" (written by J. Brandrup, E. H. Immergut (Wiley-Interscience, 1989)) may be employable herein.

The polymer solid concentration in the vinyl chloride-based polymer latex for use in the invention is preferably from 10 to 70% by mass relative to the latex dispersion, more preferably from 20 to 60% by mass. The coating amount of the total polymer latex solid in the receiving layer is preferably from 50 to 98% by mass of the total solid coating amount in the receiving layer, more preferably from 70 to 95% by mass.

The vinyl chloride-based polymer latex may have a uniform structure or a core/shell structure, in which the resins constituting the core and the shell may have a different glass transition temperature.

The vinyl chloride-based polymer latex for use in the invention may be produced according to a known method.

By changing the amount of vinyl chloride to be added thereto, a vinyl chloride-based polymer latex having a different vinyl chloride content can be produced; and a vinyl chloride homopolymer may be produced according to the process in Production Example 1 below to which, however, butyl acrylate is not added.

Other vinyl chloride-based copolymer latex may be produced according to the process in which, however, butyl acrylate to be copolymerized is changed to any other monomer.

(Other Polymer Latex)

In the invention, so far as the proportion of vinyl chloride falls within the range defined in the invention, the vinyl chloride-based polymer latex may be in the dye layer singly as it is or as a mixture combined with any other compound (e.g., vinyl chloride-based polymer latex in which the vinyl chloride content is outside the range defined in the invention, or polymer latex not containing vinyl chloride). The other polymer latex is described below.

The vinyl chloride-based polymer latex for use in the invention may be a mixture thereof with any other polymer latex. The other polymer latex includes polyester latex, and vinyl chloride-containing copolymer latex such as vinyl chloride/acrylic compound copolymer latex, vinyl chloride/vinyl acetate copolymer latex, vinyl chloride/vinyl acetate/acrylic compound copolymer latex, etc.; and any one or more of these are preferred either singly or as combined.

The preferred vinyl chloride-containing copolymer latex to be combined with the vinyl chloride-based polymer latex includes, for example, Vinybran 240, Vinybran 270, Vinybran 276, Vinybran 277, Vinybran 375, Vinybran 380, Vinybran 386, Vinybran 410, Vinybran 430, Vinybran 432, Vinybran 550, Vinybran 601, Vinybran 602, Vinybran 609, Vinybran 619, Vinybran 680, Vinybran 680S, Vinybran 681N, Vinybran 683, Vinybran 685R, Vinybran 690, Vinybran 860, Vinybran 863, Vinybran 685, Vinybran 867, Vinybran 900, Vinybran 938, Vinybran 950 (all by Nisshin Chemical Industry); SE1320 and S-830 (both by Sumitomo Chemtec). These are not within the range of the vinyl chloride-based polymer latex as defined in the invention, but are preferably used as combined with the vinyl chloride-based polymer latex in the dye layer.

Other polymer latex than the vinyl chloride-containing copolymer latex, which is preferred to be combined with the vinyl chloride-based polymer latex in the dye layer in the invention, is a polyester polymer latex, for example, including Vylonal MD1200, Vylonal MD1220, Vylonal MD1245, Vylonal MD1250, Vylonal MD1500, Vylonal MD1930, Vylonal MD1985 (all by Toyobo).

Of those, vinyl chloride-containing copolymer latex such as vinyl chloride/acrylic compound copolymer latex, vinyl chloride/vinyl acetate copolymer latex or vinyl chloride/vinyl acetate/acrylic compound copolymer latex is more preferred to be combined with the vinyl chloride-based polymer latex in the invention.

(Polyether-Modified Silicone)

The receiving layer contains a polyether-modified silicone.

The polyether-modified silicone is an indispensable ingredient to exhibit the effect of not only securing the releasability between the thermal transfer sheet and the thermal transfer image-receiving sheet in image printing but also bettering the gloss evenness of the image-outputted print in a high-temperature high-humidity environment in the invention.

Preferably, the polyether-modified silicone for use in the invention is liquid at 25° C.

Preferably, the polyether-modified silicone for use in the invention does not have an epoxy group, more preferably it is non-reactive.

The polyether-modified silicone for use in the invention is preferably a semiterminal-modified compound represented by the following formula (1), a both-terminal-modified compound represented by the following formula (2), a side chain-modified compound represented by the following formula (3), or a main chain-copolymerized compound represented by the following formula (4).

Formula (1)

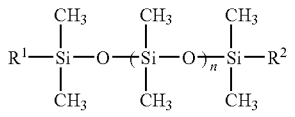

Formula (2)

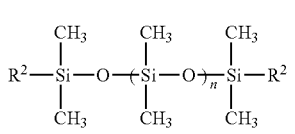

Formula (3)

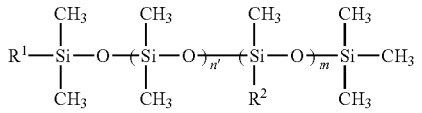

Formula (4)

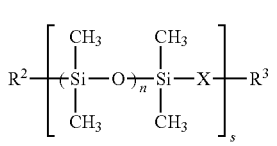

In formulae (1) to (4), $R^1$ represents an alkyl group; $R^2$ each independently represents —Y—$(C_2H_4O)_a$—$(C_3H_6O)_b$—$R^4$; $R^3$ represents a hydrogen atom, an acyl group having at least one acyl moiety, an at least monovalent alkyl group, an at least monovalent cycloalkyl group, or an at least monovalent aryl group; $R^4$ each independently represents a hydrogen atom, an acyl group, an alkyl group, a cycloalkyl group or an aryl group; Y represents a single bond or a divalent linking group; X represents a divalent linking group; n indicates a positive number; n' indicates 0 or a positive integer; m indicates 0 or a positive number; s indicates a positive number; a and b each independently indicate 0 or a positive number, but a and b are not 0 at the same time; and n' and m are not 0 at the same time.

The alkyl group for $R^1$ may have a substituent. The alkyl group for $R^1$ preferably has from 1 to 20 carbon atoms, more preferably from 1 to 8 carbon atoms, even more preferably from 1 to 4 carbon atoms. The alkyl group is preferably an unsubstituted alkyl group rather than a substituted alkyl group. Above all, preferred is a methyl group or an ethyl group; and most preferred is a methyl group.

Of the acyl group having at least one acyl moiety for $R^3$, the acyl group having one acyl moiety includes, for example, an acetyl group, a propionyl group, a butyryl group, a benzoyl group; the acyl group having two acyl moieties includes, for example, an oxalyl group, a malonyl group, a succinoyl group, maleoyl group, terephthaloyl group; the acyl group having three acyl moieties includes, for example, a 1,2,3-propanetricarbonyl group. The acyl group preferably has from 2 to 20 carbon atoms, more preferably from 2 to 10 carbon atoms.

Of the at least monovalent alkyl group for $R^3$, the monovalent alkyl group includes, for example, a methyl group, an ethyl group, a propyl group, an isopropyl group, a butyl group a tert-butyl group; the divalent alkyl group includes, for example, a methylene group, an ethylene group, a propylene group; the trivalent alkyl group includes, for example, a 1,2,3-propane-triyl group; the tetravalent alkyl group includes, for example, a 1,2,2,3-propane-tetrayl group. The alkyl group preferably has from 1 to 20 carbon atoms, more preferably from 1 to 10 carbon atoms.

Of the at least monovalent cycloalkyl group for $R^3$, the monovalent cycloalkyl group includes, for example, a cyclopentyl group, a cyclohexyl group; the divalent cycloalkyl group includes, for example, a divalent cyclohexyl group such as a 1,3-cyclopentylene group, a 1,4-cyclopentylene group; the trivalent cycloalkyl group includes, for example, a 1,3,5-cyclohexane-triyl group. The cyclohexyl group preferably has from 5 to 10 carbon atoms.

Of the at least monovalent aryl group for $R^3$, the monovalent aryl group includes, for example, a phenyl group, a naphthyl group; the divalent aryl group includes, for example, a phenylene group; the trivalent aryl group includes, for example, a benzene-1,3,5-triyl group. The aryl moiety of the aryl group is preferably a benzene ring. Preferably, $R^3$ is a monovalent alkyl group.

The acyl group for $R^4$ preferably has at most 20 carbon atoms, more preferably at most 10 carbon atoms, even more preferably at most 5 carbon atoms; and most preferred is an acetyl group.

The alkyl group for $R^4$ may have a substituent. The alkyl group for $R^4$ preferably has from 1 to 20 carbon atoms, more preferably from 1 to 8 carbon atoms, even more preferably from 1 to 4 carbon atoms. $R^4$ is preferably an unsubstituted alkyl group rather than a substituted alkyl group. Above all, preferred is a methyl group or an ethyl group; and most preferred is a methyl group.

The cycloalkyl group for $R^4$ may have a substituent. Preferred is a cyclopentyl group or a cyclohexyl group; and more preferred is an unsubstituted cycloalkyl group.

The aryl group for $R^4$ may have a substituent, including a phenyl group and a naphthyl group. Preferred is a phenyl group. As the substituent, preferred are an alkyl group and a halogen atom; however, an unsubstituted phenyl group is the most preferred.

$R^4$ is preferably a hydrogen atom, an acyl group, an alkyl group or an aryl group, more preferably a hydrogen atom, an acyl group or an alkyl group, even more preferably an alkyl group.

The divalent linking group for X and Y are independently preferably an alkylene group or an alkyleneoxy group; and for example, the alkylene group includes a methylene group, an ethylene group and a propylene group, and the alkyleneoxy group includes, for example, —$CH_2CH_2O$—, —$CH(CH_3)CH_2O$—, —$CH_2CH(CH_3)O$— and —$(CH_2)_3O$—; and these are preferred. The linking group preferably has from 1 to 4 carbon atoms, more preferably 2 or 3 carbon atoms.

X and Y are preferably a single bond or the above-mentioned preferred divalent linking group.

a and b are independently preferably 0 or an integer of 1 or more, more preferably from 0 to 500, even more preferably from 0 to 200.

n is preferably from 1 to 1000; n' and m each are preferably from 0 to 1000.

s is preferably from 1 to 10, more preferably from 1 to 6, even more preferably from 1 to 4.

Of the polyether-modified silicones of formulae (1) to (4), preferred are those of formulae (2) to (4), more preferred are those of formulae (2) and (3), and most preferred are those of formula (3).

The polyether-modified silicone for use in the invention preferably has an HLB value (hydrophile-lipophile balance) of from 5 to 9, more preferably from 5 to 7. When the HLB value is too low, then the compound may separate and aggregate in the coating liquid, therefore causing surface defects of the coating layer. When the HLB value is too high, then the release effect of the compound and the orientation effect on the surface of latex particles thereof may be insufficient, or that is, the compound could not sufficiently exhibit its effect.

In the invention, the HLB value is computed according to the computational formula defined by the following formula (A), based on the Griffin method (Nishi, Imai & Kasai's "Handbook for Surfactant" published by Sangyo Tosho, 1960).

$$HLB=20\times Mw/M \quad (A)$$

wherein M means the molecular weight, and Mw means the formula weight (molecular weight) of the hydrophilic moiety. In this connection, M=Mw+Mo, in which Mo is the formula weight (molecular weight) of the oleophilic moiety.

Specific examples of the polyether-modified silicone for use in the invention include Shin-etsu Chemical's KF-351A, KF-352A, KF-353, KF-354L, KF-355A, KF-615A, KF-945, KF-640, KF-642, KF-643, KF-6020, KF-6011, KF-6012, KF-6015, KF-6017, X-22-4515, X-22-6191; Toray Dow Corning's SH3749, SH3773M, SH8400, SF8427, SF8428, FZ-2101, FZ-2104, FZ-2110, FZ-2118, FZ-2162, FZ-2203, FZ-2207, FZ-2208, FZ-77, L-7001, L-7002 (all trade names).

The polyether-modified silicone for use in the invention can be readily produced, for example, according to the methods described in JP-A 2002-179797, 2008-1896, 2008-1897, or according to methods similar thereto.

In the invention, polyether-modified silicones can be used either singly or as combined. In the invention, any other release agent may be used in combination with the polyether-modified silicone for use in the invention.

The amount of the polyether-modified silicone to be added to the receiving layer is preferably from 1% by mass to 20% by mass relative to the total polymer latex in the layer, more preferably from 1% by mass to 10% by mass.

(Water-Soluble Polymer)

In one embodiment of the invention, the receiving layer of the thermal transfer image-receiving sheet and the heat-insulating layer thereof to be mentioned below contain a water-soluble polymer.

The water-soluble polymer means that at least 0.05 g of the polymer can dissolve in 100 g of water at 20° C., more preferably at least 0.1 g, even more preferably at least 0.5 g, still more preferably at least 1 g of the polymer can dissolve therein. As the water-soluble polymer, preferred for use herein are any of natural polymers, semisynthetic polymers and synthetic polymers.

Of the water-soluble polymers, for use in the thermal transfer image-receiving sheet, natural polymers and semisynthetic polymers are described in detail. Vegetable-derived polysaccharides include κ-carrageenan, ι-carrageenan, λ-carrageenan, pectin, etc.; microorganismic polysaccharides include xanthan gum, dextrin, etc.; animal-derived natural polymers include gelatin, casein, etc. Cellulosic polymers include carboxymethyl cellulose, hydroxyethyl cellulose, hydroxypropyl cellulose, etc.

Of the natural polymers and semisynthetic polymers for use in the invention, preferred is gelatin. Gelatin having a molecular weight of from 10,000 to 1,000,000 can be used; and gelatin ay contain an anion such as $Cl^-$, $SO_4^{2-}$, etc., and may contain a cation such as $Fe^{2+}$, $Ca^{2+}$, $Mg^{2+}$, $Sn^{2+}$, $Zn^{2+}$, etc. Preferably, gelatin is dissolved in water and added.

Of the water-soluble polymer for use in the thermal transfer image-receiving sheet, synthetic polymers include polyvinyl pyrrolidone, polyvinyl pyrrolidone copolymer, polyvinyl alcohol, polyethylene glycol, polypropylene glycol, water-soluble polyester, etc.

Of the synthetic polymers for use in the invention, preferred are polyvinyl alcohols.

Various types of polyvinyl alcohols are usable, including completely saponified compounds, partially saponified compounds, modified polyvinyl alcohols, etc. These polyvinyl alcohols are described in Nagano et al's "Poval" (published by Kobunshi Kanko-kai), and are usable in the invention.

The viscosity of polyvinyl alcohol can be regulated and stabilized by a minor amount of a solvent or an inorganic salt added to the aqueous solution thereof, and precisely, those described in the above-mentioned reference, Nagano et al's "Poval" (published by Kobunshi Kanko-kai), pp. 144-154 can be used here. As one typical example, boric acid may be added to polyvinyl alcohol so as to improve the quality of the coating film. Preferably, the amount of boric acid to be added is from 0.01 to 40% by mass relative to polyvinyl alcohol.

As specific examples of polyvinyl alcohol, completely saponified products include PVA-105, PVA-110, PVA-117, PVA-117H, etc.; partially saponified products include PVA-203, PVA-205, PVA-210, PVA-220, etc.; modified polyvinyl alcohols include C-118, HL-12E, KL-118, MP-203, etc.

In the invention, for the water-soluble polymer, preferred are gelatin and polyvinyl alcohol, and more preferred is gelatin.

(Other Additives)

The receiving layer ma contain UV absorbent, lubricant, antioxidant, preservative, surfactant, filming promoter, hardener.

The coating amount of the receiving layer is preferably from 0.5 to 10 g/m$^2$ (as the solid content—unless otherwise specifically indicated, the coating amount in the invention is in terms of the solid content of the coating matter). Preferably, the thickness of the receiving layer is from 1 to 20 μm.

<Heat-Insulating Layer>

In the invention, the thermal transfer image-receiving sheet has at least one heat-insulating layer. The heat-insulating layer is not limited to one layer but may be two or more layers. In the latter case, at least one heat-insulating layer is preferably disposed between the receiving layer and the support.

(Hollow Polymer Particles)

In the invention, the heat-insulating layer preferably contains hollow polymer particles.

The hollow polymer particles (hereinafter this may be referred to as "hollow particles") in the invention are polymer particles having a hollow inside the particles. The hollow particles are preferably in the form of aqueous dispersion, including, for example, 1) non-foaming hollow polymer particles of such that a dispersant such as water is inside the partitioning walls formed of polystyrene, acrylic resin, styrene-acrylic resin or the like, and after coating and drying, the dispersant water inside the particles is evaporated away from the particles to give hollow particles; 2) foaming microballoons of such that a low-boiling-point liquid such as butane, pentane or the like is enveloped with a resin comprising any of polyvinylidene chloride, polyacrylonitrile, polyacrylic acid, polyacrylate, or their mixture or polymer, and after coating, the low-boiling-point liquid inside the particles is expanded to give a hollow space inside the foamed particles; 3) microballoons prepared by previously heating and foaming the above 2) to be hollow particles; etc.

Of those, the hollow particles in the invention are preferably the above-mentioned 1) non-foaming hollow particles, and if desired, two or more different types of those hollow particles may be mixed for use herein. Their concrete examples are Rohm & Haas' Rohpake HP-1055, JSR's SX866 (B), Nippon Zeon's Nipol MH5055 (all trade names).

Preferably, the mean particle size of the hollow particles in the heat-insulating layer in the invention is from 0.1 μm to 5.0 μm.

Also preferably, the hollow particles for use in the heat-insulating layer have a degree of hollowness of from 20 to 80% or so, more preferably from 30 to 70% or so.

The mean particle size of the hollow particles for use in the heat-insulating layer may be computed as follows: Using a transmission electronic microscope, the circle-equivalent outer diameter of each particle is measured, and the data are averaged. Concretely, at least 300 hollow particles are analyzed with a transmission electronic microscope, and the circle-equivalent outer diameter of each particle is measured, and the data are averaged.

The degree of hollowness of the hollow particles may be derived from the proportion of the volume of the space part in a particle to the volume of the particle.

As the resin property thereof, the hollow particles preferably have a glass transition temperature (Tg) of from 70° C. to 200° C., more preferably from 90° C. to 180° C. As the hollow particles, more preferred is hollow particle latex.

(Water-Soluble Polymer)

In the thermal transfer image-receiving sheet, the heat-insulating layer containing hollow particles preferably contains a water-soluble polymer serving as a binder, in addition to the hollow particles therein. Examples of the water-soluble polymer may be the same as those described in the section of the receiving layer hereinabove. Of the water-soluble polymers, preferred are gelatin and polyvinyl alcohols, and more preferred is gelatin. These resins may be used either singly or as combined.

The coating amount of the heat-insulating layer is preferably from 1.0 to 15 g/m$^2$, more preferably from 2.5 to 10 g/m$^2$.

<Interlayer>

Apart from the heat-insulating layer, any other interlayer may be formed between the receiving layer and the support. The functions of the interlayer include white background regulation, static charge prevention, adhesiveness impartation, smoothness impartation, etc.; however, the interlayers are not limited to these, and any conventional known interlayers may be provided.

In the invention, such an interlayer is provided between the receiving layer and the heat-insulating layer, and the interlayer preferably contains hollow particles, more preferably hollow particles and a polymer latex. In this case, the hollow particles are preferably the same ones as those described in the section of the heat-insulating layer. In this case, the polymer latex includes a polyester latex, and a vinyl chloride copolymer latex such as vinyl chloride/acrylic compound copolymer latex, vinyl chloride/vinyl acetate copolymer latex, vinyl chloride/vinyl acetate/acrylic compound copolymer latex, etc.; and preferred is the vinyl chloride-based polymer latex. Also preferably, the interlayer contains a water-soluble polymer such as that described in the section of the receiving layer.

<Curling Preventing Layer>

Preferably but if desired, a curling preventing layer may be provided in the thermal transfer image-receiving sheet. For the curling preventing layer, usable is a polyethylene laminate, a polypropylene laminate or the like. Concretely, for example, the curling preventing layer may be provided in the same manner as in JP-A 61-110135, 6-202295.

<Writing Layer/Antistatic Layer>

If desired, a writing layer and an antistatic layer may be provided in the thermal transfer image-receiving sheet. An inorganic oxide colloid, an ionic polymer or the like may be used in forming the writing layer and the antistatic layer. As the antistatic agent, for example, usable are cationic antistatic agents such as quaternary ammonium salts, polyamine derivatives, etc.; anionic antistatic agents such as alkyl phosphates, etc.; nonionic antistatic agents such as fatty acid esters, etc. Concretely, for example, the layers may be formed in the same manner as in Japanese Patent 3585585.

<Additives that May be in the Constitutive Layers of Thermal Transfer Image-Receiving Sheet>

(UV Absorbent)

The thermal transfer image-receiving sheet may contain a UV absorbent. The UV absorbent may be any known inorganic UV absorbent or organic UV absorbent. The organic UV absorbent includes salicylate-based, benzophenone-based, benzotriazole-based, triazine-based, substituted acrylonitrile-based, or hindered amine-based non-reactive UV absorbents, and those derived from such non-reactive UV absorbents by introducing thereinto an addition-polymerizing double bond-having group such as a vinyl group, an acryloyl group or a methacryloyl group, or an alcoholic hydroxyl group, an amino group, a carboxyl group, an epoxy group, an isocyanate group or the like, or by copolymerizing or grafting a thermoplastic resin such as an acrylic resin with the UV absorbent. Disclosed is a method of dissolving a UV absorbent in a resin monomer or oligomer followed by polymerizing the monomer or oligomer (JP-A 2006-21333), and the UV-shielding resins thus produced are also usable herein. In this case, the UV absorbent may be a non-reactive one.

Of such UV absorbents, especially preferred are benzophenone-based, benzotriazole-based or triazine based UV absorbents. Preferably, the UV absorbents are combined for use herein in such a manner that the combined mixture can cover the effective UV absorption wavelength range in accordance with the characteristics of the dye to be used for image formation. Preferably, non-reactive UV absorbents having different structures are combined so that the UV absorbents used in the thermal transfer image-receiving sheet do not precipitate out.

UV absorbents usable herein are available as commercial products, such as Tinuvin P (by Ciba-Geigy), JF-77 (by Johoku Chemical), Seesorb 701 (by Shiraishi Calcium), Sumisorb 200 (by Sumitomo Chemical), Biosorb 520 (by Kyodo Chemical), Adekastab LA-21 (by Adeka), etc.

Surfactant:

Surfactant may be added to the constitutive layers of the thermal transfer image-receiving sheet. Preferably, surfactant is added to the receiving layer and the interlayer.

The amount of the surfactant to be added is preferably from 0.01 to 5% by mass relative to the total solid content of the coating matter, more preferably from 0.01 to 1% by mass, even more preferably from 0.02 to 0.2% by mass.

Various anionic, nonionic and cationic surfactants are known. Any known surfactants are usable in the invention; and for example, those introduced by "Functional Surfactants" by Tsunoda, August 2000, Chap. 6 may be used. Above all, preferred are anionic fluorine-containing surfactants.

Preservative:

The thermal transfer image-receiving sheet may contain a preservative. The preservative to be added to the thermal transfer image-receiving sheet is not specifically defined. For example, herein usable are those described in "Antiseptic Antifungal Handbook" by Horiguchi, Giho-do Publishing (1986); "Antibacterial and Antifungal Chemistry" by Sankyo Publishing (1986); "Encyclopedia of Antibacterials and Antifungals" by the Society of Antibacterial and Antifungal Agents of Japan (1986), etc. Concretely, there are mentioned imidazole derivatives, sodium dehydroacetate, 4-isothiazolin-3-one derivatives, benzoisothiazolin-3-one, benzotriazole derivatives, amidine-guanidine derivatives, quaternary ammonium salts, pyrrolidine, quinoline and guanidine derivatives, diazine and triazole derivatives, oxazole and oxazine derivatives, 2-mercaptopyridine-N-oxide and its salts, etc. Of those, preferred are 4-isothiazolin-3-one derivatives and benzoisothiazolin-3-one.

Filming Promoter:

Preferably, a high-boiling-point solvent is added to the thermal transfer image-receiving sheet. The high-boiling-point solvent is an organic compound (generally an organic solvent) that functions as a filming promoter or a plasticizer and lowers the lowermost filming temperature of polymer latex, and is described, for example, in Muroi's "Chemistry of Synthetic Latex" by Kobunshi Kanko-kai (1970). Examples of the high-boiling-point solvent (filming promoter) are the following:

Z-1: benzyl alcohols

Z-2: 2,2,4-trimethylpentanediol 1,3-monoisobutyrates

Z-3: 2-diethylaminoethanols

Z-4: diethylene glycols

When the high-boiling-point solvent is added, then images may be blurred and the solvent may be often unfavorable in practical use; however, when the solid content of the solvent in the coating film is at most 1%, then it may cause no problem to the performance.

Hardener:

A hardener may be added to the thermal transfer image-receiving sheet. It may be added to the coating layer (e.g., receiving layer, heat-insulating layer, undercoat layer) of the thermal transfer image-receiving sheet.

As the hardener for use in the invention, preferred are H-1, 4, 6, 8, 14 on page 17 of JP-A 1-214845; compounds (H-1 to 54) of formulae (VII) to (XII) in columns 13 to 23 of U.S. Pat.

No. 4,618,573; compounds (H-1 to 76), especially H-14, of formula (6) in the right lower part of page 8 of JP-A 2-214852; and compounds as claimed in claim 1 in U.S. Pat. No. 3,325,287. Examples of the hardener are shown in U.S. Pat. No. 4,678,739, column 41; U.S. Pat. No. 4,791,042; JP-A 59-116655, 62-245261, 61-18942, 4-218044. More concretely, there are mentioned aldehyde-type hardeners (e.g., formaldehyde), aziridine-type hardeners, epoxy-type hardeners, vinylsulfone-type hardeners (e.g., N,N'-ethylenebis(vinylsulfonylacetamide)ethane), N-methylol-type hardeners (e.g., dimethylolurea), boric acid, metaboric acid or polymer hardeners (e.g., compounds described in JP-A 62-234157).

Preferred are vinylsulfone-type hardeners and chlorotriazines.

Mat Agent:

A mat agent may be added to the thermal transfer image-receiving sheet for prevention of blocking, for impartation of releasability and for impartation of lubricity. The mat agent may be added to the surface of the thermal transfer image-receiving sheet on which the receiving layer is formed, or to the surface thereof opposite to the surface on which the receiving layer is formed, or to the two surfaces thereof.

The mat agent generally comprises fine particles of an organic compound or an inorganic compound insoluble in water. From the viewpoint of the dispersibility, in the invention, preferred is use of fine particles containing an organic compound. Containing an organic compound, the particles may be any of organic compound particles of an organic compound alone or organic/inorganic composite particles containing not only an organic compound but also an inorganic compound. Examples of the mat agent usable herein are described in U.S. Pat. Nos. 1,939,213, 2,701,245, 2,322,037, 3,262,782, 3,539,344, 3,767,448.

[Method for Producing Thermal Transfer Image-Receiving Sheet]

A method for producing the thermal transfer-image receiving sheet for use in the invention is described below.

In for producing the thermal transfer-image receiving sheet, at least one receiving layer of the sheet is formed of a water-based coating liquid. In case where the sheet has plural receiving layers, preferably, all these receiving layers are formed by coating with a water-based coating liquid followed by drying. "Water-based" as referred to herein means that water accounts for at least 60% by mass of the solvent (dispersant) of the coating liquid. The other ingredient than water in the coating liquid may be a water-miscible organic solvent such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, oxyethyl phenyl ether, etc.

The layers may be formed according to an ordinary coating method of roll coating, bar coating, gravure coating, gravure reverse coating, die coating, slide coating, curtain coating or the like. The receiving layer and the interlayer may be formed separately. Preferably in the invention, some of the coating layers are, as combined, formed by the simultaneous multilayer coating method.

[Thermal Transfer Sheet]

The thermal transfer sheet for use in the invention has at least one subbing layer of a titanium oxide film on a substrate film, and has a dye layer on a part of the subbing layer and a transferable protective layer laminate on the other part of the subbing layer than the part for the dye layer thereon. The thermal transfer sheet (hereinafter this may be referred to as "ink sheet") is described in detail hereinunder.

<Constitution of Thermal Transfer Sheet>

The thermal transfer sheet (ink sheet) is put on a thermal transfer image-receiving sheet in thermal transfer image formation thereon, and these are heated with a heating device such as thermal printer head or the like from the side of the ink sheet to thereby transfer the dye (colorant) from the ink sheet onto the thermal transfer image-receiving sheet.

In the invention, the thermal transfer sheet has, on one side of a substrate film, a subbing layer and a dye layer containing a transferable dye and a resin in that order from the side nearer to the substrate, and has, in the part different from the part of the dye layer on the subbing layer, a transferable protective layer laminate. On the other side of the substrate film, preferably the thermal transfer sheet has a heat-resistant lubricant layer containing a lubricant and a resin. An easy-adhesion layer (primer layer) may be provided between the substrate film and the heat-resistant lubricant layer.

<Substrate Film>

Not specifically defined in the invention, the substrate film in the thermal transfer sheet may be any conventional known one satisfying the desired heat, resistance and strength. For the substrate film, for example, preferred are thin paper such as glassine paper, condenser paper, puffin paper, etc.; heat-resistant polyesters such as polyethylene terephthalate, polyethylene naphthalate, polybutylene terephthalate, etc.; stretched or unstretched films of plastics such as polyphenylene sulfide, polyether ketone, polyether sulfone, polypropylene, polycarbonate, cellulose acetate, polyethylene derivative, polyvinyl chloride, polyvinylidene chloride, polystyrene, polyamide, polyimide, polymethylpentene, ionomer, etc.; laminates of those materials, etc. Of those, more preferred are polyester films, and even more preferred are stretched polyester films. Especially preferably, an easy-adhesion layer is formed on at least one surface of the substrate film, and the film is then stretched.

The thickness of the substrate film may be suitably defined in accordance with the material of the film so that the film could have intended strength and heat resistance. Preferably, the thickness is from 1 to 30 μm or so, more preferably from 1 to 20 μm or so, even more preferably from 3 to 10 μm or so.

The substrate film of the thermal transfer sheet may be processed for easy adhesion treatment for the purpose of enhancing the wettability and the adhesiveness of the coating liquid to be applied thereto. For the easy adhesion treatment, employable are known resin surface modification techniques of, for example, corona discharge treatment, flame treatment, ozone treatment, UV treatment, radiation treatment, surface-roughening treatment, chemical treatment, vacuum plasma treatment, atmospheric plasma treatment, primer treatment, graftation treatment, etc.

When the substrate film for use in the invention is formed through melt extrusion, the unstretched film may be coated with the constitutive layers and then stretched.

The above treatments may be combined.

<Subbing Layer>

In the invention, the subbing layer of the thermal transfer sheet is a titanium oxide film.

In the thermal transfer sheet, when the subbing layer is a titanium oxide film, the transfer efficiency of the sheet may be enhanced.

In the thermal transfer sheet, the subbing layer of a titanium oxide film is combined with the dye layer to be mentioned below, whereby the adhesiveness between the dye layer and the substrate may be further enhanced.

In the thermal transfer sheet, the subbing layer of a titanium oxide film is combined with the transferable protective layer laminate to be mentioned below, whereby the gloss of the protective layer transferred onto the print is bettered.

In the image formation method of the invention, the thermal transfer sheet having a subbing layer of a titanium oxide film is applied to the thermal transfer image-receiving sheet containing a vinyl chloride-based polymer latex in the receiving layer, or to the thermal transfer image-receiving sheet containing a polyether-modified silicone in the receiving layer, or to the thermal transfer image-receiving sheet containing the two in the receiving layer for image formation on the latter, whereby the glossiness of the formed image is bettered, and the problem with the invention is solved.

The titanium oxide film is preferably a polycondensation product of a titanium alkoxide or its partial hydrolyzate, organotitania sol.

This is available as commercial products, and for example, there are mentioned tetra-i-propoxytitanium (TPT) (trade name A-1, by Nippon Soda), tetra-n-butoxytitanium (TBT) (trade name B-1, by Nippon Soda), tetra-n-butyl titanate dimer, tetraisopropyl titanate, tetrastearyl titanate, tetra-n-butyl titanate, tetraisopropyl titanate 50, triethanolamine titanate (all products by Mitsubishi Gas Chemical), Tyzor TPT, Tyzor TBT (trade names, by DuPont), etc.

The solid coating amount of the subbing layer is preferably from 0.01 $g/m^2$ to 0.20 $g/m^2$, more preferably from 0.08 to 0.17 $g/m^2$, even more preferably from 0.10 to 0.15 $g/m^2$. When the solid coating amount of the subbing layer is at least 0.01 $g/m^2$, then the dye transfer, density increases significantly and the effect of the invention is sufficient.

(Method for Forming Subbing Layer)

Concretely, the subbing layer of titanium oxide film may be formed by solvent coating with a titanium alkoxide or its partial hydrolyzate, organotitania sol followed by heating for polycondensation.

Titanium alkoxide means a compound of a titanium atom to which an alkoxide, or that is, "—OR" bonds.

Such a titanium alkoxide is dissolved in a suitably selected solvent, then applied onto a substrate and optionally heated with steam given thereto to form a titanium oxide film.

An organotitania sol prepared by mixing 1 mol of a titanium alkoxide with from 0.5 to 2.0 mols of water may be mixed with a suitably selected solvent, then applied onto a substrate and heated to form a titanium oxide film. An acid catalyst or a base catalyst may be added to the coating liquid for the subbing layer.

The solvent in the coating liquid may be an alcohol such as n-butanol, isopropanol, etc.

The heating temperature is preferably from 110 to 150° C.

<Dye Layer>

(Constitution of Dye Layer)

Regarding the dye layer constitution in the thermal transfer sheet of the invention, yellow, magenta and cyan dye layers and optionally a black dye layer are separately and repeatedly formed by coating on one and the same substrate according to a frame sequential method.

In one example, yellow, magenta and cyan dye layers are separately and repeatedly formed by coating on one substrate film in the long axis direction in accordance with the area of the recording surface of the thermal transfer image-receiving sheet to be combined with the thermal transfer sheet, according to a frame sequential method. Applied to at least one layer of these three layers, a transferable protective layer (this may be a transferable protective layer laminate to be mentioned below) is needed.

In this embodiment, preferably, a mark may be put to the thermal transfer sheet for the purpose of transmitting the starting point of each color layer to printer. In the embodiment of producing a thermal transfer sheet by separately and repeatedly forming the individual layers by coating on a substrate according to a frame sequential method, the thermal transfer sheet produced enables image formation by dye transfer and protective layer lamination on the formed image all at once.

However, the invention is not limited to the mode of formation of dye layers in the manner as above. A sublimable thermal transfer dye layer and a thermofusible transfer dye layer may be provided on one substrate, or any other dye layers than yellow, magenta, cyan and black layers may be provided; and any such modification is applicable to the invention. Regarding the form thereof, the thermal transfer sheet may be a long strip-like one, or may be in the form of sheets. The invention is especially favorable to the embodiment where the thermal transfer sheets before use are stored as overlaid one upon another.

The dye layer may be a single layer or may have a multilayer structure. The compositions of the constitutive layers of the multilayer-structure having dye layer may be the same or different.

(Dye)

Not specifically defined, the dye for use in the invention may be any one capable of diffusing by heating, capable of being incorporated into a thermal transfer sheet and capable of being transferred by heating from the thermal transfer sheet to a thermal transfer image-receiving sheet, and may be any dye heretofore used for thermal transfer sheets, or may also be any known dye.

Preferred dyes for use herein are, for example, diarylmethane dyes; triarylmethane dyes; thiazole dyes; methine dyes such as merocyanine; azomethine dyes such as typically indaniline, acetophenonazomethine, pyrazoloazomethine, imidazolazomethine, imidazazomethine, pyridonazomethine; xanthene dyes; oxazine dyes; cyanomethylene dyes such as typically dicyanostyrene, tricyanostyrene; thiazine dyes; azine dyes; acridine dyes; benzenazo dyes; azo dyes such as pyridonazo dyes, thiophenazo dyes, isothiazolazo dyes, pyrrolazo dyes, pyrazolazo dyes, imidazolazo dyes, thiadiazolazo dyes, triazolazo dyes, disazo dyes; spiropyrane dyes; indolinospiropyrane dyes; fluoran dyes; rhodamine lactam dyes; naphthoquinone dyes; anthraquinone dyes; quinophthalone dyes; etc.

As specific examples, yellow dyes include Disperse Yellow 231, Disperse Yellow 201, Solvent Yellow 93, etc.; magenta dyes include Disperse Violet 26, Disperse Red 60, Solvent Red 19, etc.; and cyan dyes include Solvent Blue 63, Solvent Blue 36, Disperse Blue 354, Disperse Blue 35, etc.; however, the invention should not be restricted thereto. These dyes of different colors may be combined in any desired manner for use herein.

(Binder for Dye Layer)

In the thermal transfer sheet for use in the invention, the dye is in a coating layer provided on the substrate film generally as dispersed in a polymer compound referred to as a binder (resin, binder resin). Any known binder resin may be used in the dye layer in the invention. For example, there are mentioned acrylic resins such as polyacrylonitrile, polyacrylate, polyacrylamide, etc.; polyvinyl acetal resins such as polyvinyl acetacetal, polyvinyl butyral, etc.; modified cellulose resins such as ethyl cellulose, hydroxyethyl cellulose, ethyl hydroxycellulose, hydroxypropyl cellulose, ethylhydroxyethyl cellulose, methyl cellulose, cellulose acetate, cellulose acetate butyrate, cellulose acetate propionate, cellulose nitrate, etc.; cellulose resins such as nitrocellulose, ethylhydroxyethyl cellulose, ethyl cellulose, etc.; polyurethane resins, polyamide resins, polyester resins, polycarbonate resins, phenoxy resins, phenolic resins, epoxy resins, various elastomers. The dye layer may be formed of at least one resin selected from those mentioned above.

These resins may be used singly, or may be used as mixed or as copolymerized, or may be crosslinked with various crosslinking agents.

As the binder resin to be in the dye layer in the invention, preferred are cellulose resins and polyvinyl acetal resins, and more preferred are polyvinyl acetal resins. Above all, even more preferred for use in the invention are polyvinyl acetacetal resins and polyvinyl butyral resins.

The ratio (by mass) of the binder to the dye in the dye layer may be any one, but is preferably from 0.1 to 5.0, more preferably from 0.5 to 3.0, even more preferably from 0.9 to 2.0.

(Method of Forming Dye Layer)

The dye layer containing a dye to be transferred (preferably a sublimable dye) may be formed by coating with a dye layer coating liquid.

The dye layer coating liquid contains a dye transferable under heat, and a binder resin, and may optionally contain an organic fine powder or an inorganic fine powder, wax, a silicone resin, a fluorine-containing organic compound and the like.

In the dye layer of the thermal transfer sheet for use in the invention, the solid content of the dye to the total solid content in the dye layer is preferably from 20 to 80% by mass, more preferably from 30 to 70% by mass.

The dye layer may be formed according to an ordinary coating method of roll coating, bar coating, gravure coating, gravure reverse coating or the like. The coating amount of the dye layer is preferably from 0.1 to 2.0 g/m$^2$ (as solid—unless otherwise specifically indicated, the coating amount in the invention is in terms of the solid content thereof), more preferably from 0.2 to 1.2 g/m$^2$. Preferably, the thickness of the dye layer is from 0.1 to 2.0 μm, more preferably from 0.2 to 1.2 μm.

<Transferable Protective Layer Laminate>

The thermal transfer sheet has a transferable protective layer laminate on the other part of the subbing layer than the part for the dye layer thereon.

The transferable protective layer laminate forms a protective layer of a transparent resin through thermal transfer onto the image formed on the thermal transfer image-receiving sheet, thereby covering and protecting the image, and this is for enhancing the durability such as the rubbing resistance, the lightfastness and the weather resistance of the image. In case where the transferred image is kept exposed on the surface of the image-receiving sheet and in case where the image durability such as the lightfastness, the rubbing resistance and the chemical resistance of the image is insufficient, the protective layer is effective.

The transferable protective layer laminate comprises a release layer, a protective layer and an adhesive layer formed on a substrate film in that order from the side of the substrate film. The protective layer may be composed of plural layers. In case where the protective layer has the other functions of the other layers, then the release layer and the adhesive layer may be omitted. Preferably, the transferable protective layer laminate comprises the release layer as well as the protective layer from the view point of enhancement of the effect of the invention when they are formed with the subbing layer of titanium oxide.

(Resin)

The resin to form the protective layer of the transferable protective layer is preferably a resin excellent in rubbing resistance, chemical resistance, transparency and hardness, including, for example, polyester resins, acrylic resins, polystyrene resins, polyurethane resins, acrylic urethane resins, silicone-modified resins of these resins, UV-blocking resins, mixtures of these resins, ionizing radiation-curable resins, UV-curable resins, etc. Above all, preferred are polyester resins, and acrylic resins.

The resins may be crosslinked with various crosslinking agents.

(Resin for Transferable Protective Layer)

The acrylic resin is a conventional known polymer comprising at least one monomer selected from acrylate monomers and methacrylate monomers, which may be copolymerized with styrene, acrylonitrile or the like except the acrylic monomer. Methyl methacrylate is a preferred monomer, and its content in the polymer may be at least 50% by mass.

Preferably, the acrylic resin has a molecular weight of from 20,000 to 100,000.

The polyester resin may be a conventional known saturated polyester resin. Preferably, the polyester resin has a glass transition temperature of from 50 to 120° C., and a molecular weight of from 2,000 to 40,000. More preferably, the molecular weight of the polyester resin is from 4,000 to 20,000, since the transferability of the transfer foil is bettered in transferring the protective layer.

(UV absorbent)

In the invention, preferably, the protective layer or the adhesive layer of the transferable protective layer laminate contains a UV absorbent. As the UV absorbent, any conventional known inorganic UV absorbent or organic UV absorbent can be used. The organic UV absorbent includes non-reactive UV absorbents such as salicylates, benzophenones, benzotriazoles, triazines, substituted acrylonitriles, hindered amines, etc.; and those prepared by introducing an addition-polymerizing double bond such as a vinyl group, an acryloyl group, a methacryloyl group or the like, or an alcoholic hydroxyl group, an amino group, a carboxyl group, an epoxy group, an isocyanate group or the like into those non-reactive UV absorbents followed by copolymerizing or grafting thermoplastic resins such as acrylic resins or the like with them. A method is disclosed, comprising dissolving an UV absorbent in a monomer or oligomer of resin followed by polymerizing the monomer or the oligomer (JP-A 2006-21333); and the thus-obtained UV-blocking resin may also be used here. In this case, the UV absorbent may be a non-reactive one.

Of those UV absorbents, especially preferred are benzophenones, benzotriazoles and triazines. Preferably, these UV absorbents are combined in accordance with the characteristics of the dye for use in image formation, in such a manner that the resulting combination can cover the effective UV absorption wavelength range. For non-reactive UV absorbents, preferably, a plurality of non-reactive UV absorbents each having a different structure are combined so that any UV absorbent does not precipitate out from the mixture.

Commercial products of UV absorbents are available, including, for example, Tinuvin P (by Ciba-Geigy), JF-77 (by Johoku Chemical), Seesorb 701 (by Shiraishi Calcium), Sumisorb 200 (by Sumitomo Chemical), Biosorb 520 (by Kyodo Chemical Industry), Adekastab LA-32 (by Asahi Denka) (all trade names), etc.

(Formation of Transferable Protective Layer)

The method for forming the protective layer depends on the type of the resin to be used. In general, the protective layer may be formed in the same manner as that for the dye layer mentioned above, and its thickness is preferably from 0.5 to 10 μm.

(Release Layer)

A release layer may be formed between the subbing layer of titanium oxide and the protective layer from the view point of enhancing the peelability of the protective layer from the subbing layer. A peeling layer may be formed between the transferable protective layer and the release layer. The release layer may be formed, for example, by coating with a coating liquid that contains at least one of wax, silicone wax, silicone resin, fluororesin, acrylic resin, polyvinyl alcohol resin, cellulose derivative resin, urethane resin, vinyl acetate resin, acryl vinyl ether resin, maleic anhydride resin and copolymer of those resins, according to a conventional known method of gravure coating, gravure reverse coating or the like, followed by drying it. Of the above-mentioned resins, preferred are acrylic resins formed by homopolymerization of acrylic acid, methacrylic acid or the like monomer alone or by copolymerization thereof with any other monomer, or cellulose derivative resins, as they are excellent in the adhesiveness to the subbing layer of titanium oxide and in the peelability from the protective layer.

The layer may be crosslinked with various crosslinking agents; and ionizing radiation-curable resins and UV-curable resins may also be used for the layer.

The release layer may be one that is transferred onto a transfer object through thermal transfer, or one that remains on the side of the subbing layer of titanium oxide, or one that undergoes cohesive failure, and any of these may be suitably used herein. As one preferred embodiment, the release layer is non-transferable, and remains on the side of the subbing layer of titanium oxide through thermal transfer so that the interface between the release layer and the transferable protective layer could still serve as the surface of the protective layer after thermal transfer, from the viewpoint of the surface glossiness and the transfer stability of the protective layer. The release layer may be formed according to a conventional known coating method, and its thickness is preferably from 0.5 to 5 μm or so in dry.

(Adhesive Layer)

An adhesive layer may be provided as the outermost layer of the transferable protective layer laminate, or that is, as the outermost surface of the protective layer. Accordingly, the adhesiveness of the protective layer to the transfer subject may be bettered.

<Easy-Adhesion Layer>

An easy-adhesion layer may be formed on the substrate film by coating, and in the invention, an easy-adhesion layer is preferably formed thereon. The resin for use in the easy-adhesion layer includes polyester resins, polyacrylate resins, polyvinyl acetate resins, polyvinyl chloride resins, vinyl resins such as polyvinyl alcohol resins, polyvinylacetal resins such as polyvinyl acetacetal and polyvinyl butyral, polyether resins, polyurethane resins, styrene acrylate resins, polyacrylamide resins, polyamide resins, polystyrene resins, polyethylene resins, polypropylene resins, polyvinyl pyrrolidone resins, etc.

Preferably in the invention, an easy-adhesion layer is formed on at least one side of a substrate film and then the coated film is stretched, as so mentioned in the above.

<Heat-Resistant Lubricant Layer>

Preferably, the thermal transfer sheet of the invention has a heat-resistant lubricant layer on the side (back side) of the substrate thereof opposite to the side having the dye layer or the transferable protective layer laminate, or that is, on the back side to be kept in contact with a heating element such as thermal head or the like.

The heat-resistant lubricant layer is formed so that the thermal transfer sheet could be resistant to thermal energy given thereto from a thermal head, and this prevents thermal fusion with a heating element such as thermal head or the like and enables smooth running. With the recent tendency in the art toward high-speed printing, the thermal energy from thermal head is increasing, and the necessity for the provision of the heat-resistant lubricant layer is increasing.

The heat-resistant lubricant layer may be formed by coating with a coating material prepared by adding a lubricant, a release agent, a surfactant, inorganic particles, organic particles, a pigment or the like to a binder. An interlayer may be formed between the heat-resistant lubricant layer and the support. As the interlayer, disclosed is a layer comprising inorganic fine particles and a water-soluble resin or an emulsifiable hydrophilic resin.

As the binder resin for use in the heat-resistant lubricant layer, usable are known resins that are highly resistant to heat. Examples of the resin include single substances or mixtures of natural or, synthetic resins, for example, cellulose resins such as ethyl cellulose, hydroxy cellulose, hydroxypropyl cellulose, methyl cellulose, cellulose acetate, cellulose acetate butyrate, cellulose acetate propionate, nitrocellulose, etc.; vinyl resins such as polyvinyl alcohol, polyvinyl acetate, polyvinyl butyral, polyvinyl acetal, polyvinyl acetacetal resin, vinyl chloride/vinyl acetate copolymer, polyvinyl pyrrolidone, etc.; acrylic resins such as polymethyl methacrylate, polyethyl acrylate, polyacrylamide, acrylonitrile/styrene copolymer, etc.; polyamide resins, polyimide resins, polyamidimide resins, polyvinyltoluene resins, coumarone-indene resins, polyester resins, polyurethane resins, polyether resins, polybutadiene resins, polycarbonate resins, polyolefin chloride resins, fluororesins, epoxy resins, phenolic resins, silicone resins, silicone-modified or fluorine-modified urethanes, etc.

For enhancing the heat resistance of the heat-resistant lubricant layer, known is a technique of crosslinking the resin through irradiation with UV rays or electron beams. The resin may also be crosslinked with a crosslinking agent under heat. In this case, a catalyst may be added to the layer. As the crosslinking agent, known are polyisocyanates, etc. For this, suitable is a resin having a hydroxyl group-type functional group. JP-A 62-259889 discloses formation of a heat-resistant lubricant layer by adding a filler such as an alkali metal or alkaline earth metal salt of a phosphate and calcium carbonate or the like to a reaction product of a polyvinyl butyral and an isocyanate compound. JP-A 6-99671 discloses formation of a polymer compound of forming a heat-resistant lubricant layer by reacting an amino group-having silicone compound and an isocyanate compound having at least two isocyanate groups in one molecule.

In order that the heat-resistant lubricant layer can sufficiently exhibit its function, additives such as a lubricant, a plasticizer, a stabilizer, a filler, a filler for removal of substances adhering to head and the like may be incorporated in the layer.

The lubricant includes solid lubricants of fluorides such as calcium fluoride, barium fluoride, graphite fluoride, etc.; sulfides such as molybdenum disulfide, tungsten disulfide, iron sulfide, etc.; oxides such as lead oxide, alumina, molybdenum oxide, etc.; inorganic compounds such as graphite, mica, boron nitride, clays (talc, acid clay), etc.; organic resins such as fluororesins, silicone resins, etc.; silicone oils; metal soaps such as metal stearates, etc.; waxes such as polyethylene wax, paraffin wax, etc.; surfactants such as anionic surfactants, cationic surfactants, ampholytic surfactants, nonionic surfactants, fluorine-containing surfactants, etc.

Phosphate-based surfactants such as zinc salts of alkylphosphoric monoesters or alkylphosphoric diesters may also be usable, but as having an acid radical, these are problematic in that the phosphate moiety may decompose when the quantity of heat given thereto from thermal head increases, and further the pH of the heat-resistant lubricant layer lowers to thereby increase the corrosion abrasion of thermal head. As opposed to this, known are a method of using a neutralized phosphate-based surfactant, and a method of using a neutralizing agent such as magnesium hydroxide, etc.

As other additives, also mentioned are higher fatty acid alcohols, organopolysiloxanes, organic carboxylic acids and their derivatives, and fine particles of inorganic compounds such as talc, silica, etc.

(Formation of Heat-Resistant Lubricant Layer)

The heat-resistant lubricant layer may be formed by coating with a coating liquid prepared by dissolving or dispersing a material of additives added to a binder in a solvent, according to a conventional known method of gravure coating, roll coating, blade coating, wire bar coating or the like. The thickness of the layer is preferably from 0.1 to 10 μm, more preferably from 0.2 to 5 μm.

<Dye Barrier Layer>

The thermal transfer sheet for use in the invention may have a dye barrier layer provided between the dye layer and the substrate film.

[Image Formation Method]

In the image formation method of the invention, the thermal transfer sheet and the thermal transfer image-receiving sheet are put one upon another in such a manner that the dye layer of the former is kept in contact with the receiving layer of the latter, then recording an image on the receiving layer by a heating device. The heating device is concretely a thermal head, and for example, by applying thereto heat energy corresponding to an image signal, an image is formed on the receiving layer.

In the image formation method of the invention, the dye layer of the thermal transfer sheet is formed on the subbing layer of titanium oxide, and therefore, the image formed in a high-humidity environment can secure good and uniform gloss.

In the image formation method of the invention, the transferable protective layer laminate is transferred by the heating device onto the receiving layer to complete the image formation.

In this process, preferably, the adhesive layer and the protective layer of the transferable protective layer laminate are transferred onto the receiving layer of the thermal transfer image-receiving sheet, but the release layer of the transferable protective layer laminate is not transferred onto the receiving layer of the thermal transfer image-receiving sheet, from the viewpoint of preventing the image gloss unevenness in image formation in a high-humidity environment.

Regarding the details of the method, for example, referred to are those of the method described in JP-A 2005-88545. In the invention, from the viewpoint of shortening the time to be taken before prints are provided to consumers, the printing time is preferably less than 15 seconds, more preferably from 3 to 12 seconds, even more preferably from 3 to 7 seconds.

For satisfying the above-mentioned printing time, the line speed in printing is preferably at most 2.0 msec/line, more preferably at most 1.5 msec/line, more preferably at most 0.73 msec/line, most preferably at most 0.65 msec/line. From the viewpoint of enhancing the transfer efficiency under high-speed processing condition, the ultimate temperature of the thermal head in printing is preferably from 180° C. to 450° C., more preferably from 200° C. to 450° C., even more preferably from 350° C. to 450° C.

The thermal transfer image-receiving sheet of the invention is applicable to printers, copiers and the like to be driven in a thermal transfer recording system. As the means for imparting heat energy in thermal transfer, any known impartation means may be used. For example, while the recording time is controlled by a recording device such as a thermal printer (e.g., Hitachi's trade name, Video Printer VY-100) or the like, heat energy of from 5 to 100 mJ/mm$^2$ or so is imparted whereby the intended object can be fully attained. In the thermal transfer image-receiving sheet, the support may be suitably selected, and the sheet is applicable to various uses for thermotransferable sheet-fed or roll-shaped thermal transfer image-receiving sheets, cards, sheets for transmission manuscripts, etc.

EXAMPLES

The invention is described more concretely with reference to the following Examples. In the following Examples, the material used, its amount and the ratio, the details of the treatment and the treatment process may be suitably modified or changed not overstepping the spirit and the scope of the invention. Accordingly, the invention should not be limitatively interpreted by the Examples mentioned below. In the following Examples, part and % are by mass, unless otherwise specifically indicated.

Production Example 1

Production of Receiving Layer Polymer 1 to 4

Concretely, in the invention, vinyl chloride homopolymer latex and vinyl chloride-based copolymer latex were produced according to the process mentioned below. A method for producing the receiving layer polymer 1 shown in Table 1 below is described below.

A polymerization reactor equipped with a stirrer, a condenser, a thermometer and a nitrogen gas inlet port was fully purged with nitrogen, and then deionized water (1150 g), butyl acrylate (183 g) and sodium dodecylbenzenesulfonate (30 g) were put into it. The polymerization reactor was depressurized, and vinyl chloride (900 g) was fed thereinto. The polymerization reactor was heated up to 60° C., and an aqueous 1% solution of ammonium persulfate was put into it under pressure in an amount of 50 parts by mass relative to the reaction solution, and the reaction was started. With the inner temperature kept at 60° C., the reaction was continued for 16 hours to complete the polymerization. Next, this was cooled to 30° C., and the pH of the reaction mixture was controlled to be from 7 to 8 with 25% aqueous ammonia added thereto. After the polymer latex 1 was thus prepared, the emulsion (polymer latex) was applied onto a dry glass plate, and only the polymer component was extracted out with chloroform. The extract is a receiving layer polymer 1. Further, the extract was analyzed through H-NMR, and the composition of the prepared receiving layer polymer 1 was identified as vinyl chloride/ethyl acrylate=90 mol %/10 mol %.

The other receiving layer polymers 2 to 4 shown in Table 1 above were also produced in the same manner. The details of the thus-obtained receiving layer polymers are shown in Table 1 below.

TABLE 1

| | Amount of Vinyl Chloride (g) | Amount of Butyl Acrylate (g) | Proportion of Vinyl Chloride in Polymer (mol %) |
|---|---|---|---|
| Receiving Layer Polymer 1 | 900 | 183 | 90 |
| Receiving Layer Polymer 2 | 900 | 91 | 95 |
| Receiving Layer Polymer 3 | 900 | 54 | 97 |
| Receiving Layer Polymer 4 | 900 | no | 100 |

Comparative Example 1

A thermal transfer sheet 1 and a thermal transfer image-receiving sheet 1 mentioned below were produced, and tested for image formation. This is Comparative Example 1. The details are mentioned below.

(Production of Thermal Transfer Sheet 1)

A resin and a solvent shown below for a dispersion for heat-resistant lubricant layer were previously dissolved, and the other additives were added to the solution and premixed and dispersed to prepare a dispersion for heat-resistant lubricant layer.

Dispersion for Heat-Resistant Lubricant Layer:

| | |
|---|---|
| Polyacryl-polyol resin (50% solution) (having a hydroxyl value to the resin solid content of 61, and an acid value of 5) | 51.0 mas. pts. |
| Mono and di-stearyl phosphate (Folex A-18, by Sakai Chemical Industry) | 3.6 mas. pts. |
| Zinc stearate (zinc salt of carboxylic acid having 18 carbon atoms) | 0.5 mas. pts. |
| Talc | 2.0 mas. pts. |
| Magnesium oxide | 0.5 mas. pts. |
| Methyl ethyl ketone/toluene mixed solvent | 42.4 mas. pts. |

Heat-Resistant Lubricant Layer Coating Liquid:

| | |
|---|---|
| Dispersion for heat-resistant lubricant layer mentioned above | 68.0 mas. pts. |
| Polyisocyanate (75% solution) (Burnock D-750, trade name by DIC) | 11.0 mas. pts. |
| Methyl ethyl ketone/toluene mixed solvent | 21.0 mas. pts. |

As a substrate film, a 4.5-μm thick polyester film was processed for easy adhesion treatment on one side thereof. To the other side of the film opposite to the side thereof processed for easy adhesion treatment, the above-mentioned, heat-resistant lubricant layer coating liquid 1 was applied so that the solid coating amount after dried thereon could be 1 g/m$^2$. No subbing layer was formed between the substrate film and the heat-resistant lubricant layer. The ratio of the reactive groups (—NCO/OH) in the polyisocyanate and the resin in the heat-resistant lubricant layer coating liquid was 1.1. Immediately after coating, this was dried in an oven at 100° C. for 1 minute, and then heat-treated (60° C., 20 hours) whereby the layer was cured through crosslinking between isocyanate and polyol. After the heat treatment, the sample was analyzed through IR to detect the unreacted isocyanate group, which confirmed full reaction.

On the side coated with the easy-adhesion layer of the thus-produced, heat-resistant lubricant layer-coated polyester film, a cyan dye layer was directly formed, and in, the position differing from that dye layer, a transferable protective layer laminate layer (composed of lubricant layer, protective layer and adhesive layer) was formed by coating according to a frame sequential method, thereby producing a thermal transfer sheet 1. The solid coating amount of the cyan dye layer was 0.8 g/m$^2$. The dry coating amount was 0.3 g/m$^2$ for the lubricant layer, 0.5 g/m$^2$ for the protective layer, and 2.2 g/m$^2$ for the adhesive layer. The transferable protective layer laminate was common to all Examples and Comparative Examples. Immediately after coating, the sheet was dried in an oven at 100° C. for 1 minute.

Cyan Dye Layer Coating Liquid:

| | |
|---|---|
| Dye compound (C-1 mentioned below) | 1.1 mas. pts. |
| Dye compound (C-2 mentioned below) | 6.5 mas. pts. |
| Polyvinyl acetacetal resin (S-LEC KS-1, trade name by Sekisui Chemical Industry) | 7.4 mas. pts. |
| Polyvinyl butyral resin (Denkabutyral #6000-C, trade name by Denki Kagaku Kogyo) | 0.8 mas. pts. |
| Lubricant (X-22-3000T, trade name by Shin-etsu Chemical Industry) | 0.05 mas. pts. |
| Lubricant (TSF4701, trade name by Momentive Performance Materials Japan) | 0.03 mas. pts. |
| Mat agent (FLO-THENE UF, trade name by Sumitomo Seiko) | 0.15 mas. pts. |
| Methyl ethyl ketone/toluene (2/1 by mass) | 84 mas. pts. |

(C-1)

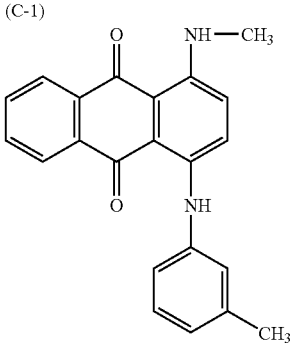

(C-2)

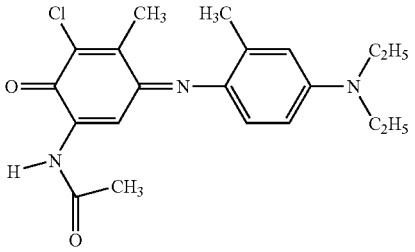

Release Layer Coating Liquid:

| | |
|---|---|
| Modified cellulose resin (L-30, trade name by Daicel Chemical) | 5.0 mas. pts. |
| Methyl ethyl ketone | 95.0 mas. pts. |

Protective Layer Coating Liquid:

| | |
|---|---|
| Acrylic resin (Dianal BR-100, trade name by Mitsubishi Rayon) | 30 mas. pts. |
| Isopropanol | 70 mas. pts. |

Adhesive Layer Coating Liquid:

| | |
|---|---|
| Acrylic resin (Dianal BR-77, trade name by Mitsubishi Rayon) | 25 mas. pts. |
| UV absorbent UV-1 mentioned below | 1 mas. pt. |
| UV absorbent UV-2 mentioned below | 2 mas. pts. |
| UV absorbent UV-3 mentioned below | 1 mas. pt. |
| UV absorbent UV-4 mentioned below | 1 mas. pt. |
| Silicone resin fine particles (Topearl 120, trade name by Momentive Performance Materials Japan) | 0.05 mas. pts. |
| Methyl ethyl ketone/toluene (2/1 by mass) | 70 mas. pts. |

(UV-1)

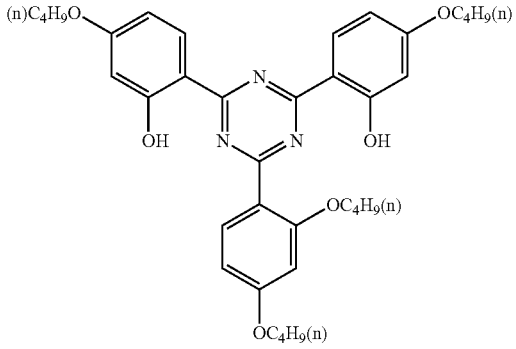

(UV-2)

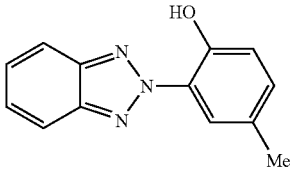

(UV-3)

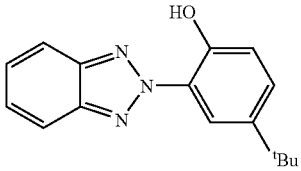

(UV-4)

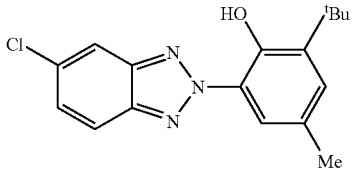

(Production of Thermal Transfer Image-Receiving Sheet 1)

The surface of a paper support double-laminated with polyethylene was processed for corona discharge treatment, and then a sodium dodecylbenzenesulfonate-containing gelatin undercoat layer was formed on it. On this, a subbing layer for thermal transfer image-receiving Sheet 1, a lower heat-insulating layer, an upper heat-insulating layer and a receiving layer (receiving layer coating liquid 1 mentioned below) were laminated by coating in that order from the side of the support through simultaneous multilayer coating method illustrated in FIG. 9 in U.S. Pat. No. 2,761,791. In this case, the heat-insulating layer nearest to the support was the lower heat-insulating layer, and the insulating layer remotest from the support was the upper heat-insulating layer. The dry coating amount of the subbing layer was 6.4 g/m$^2$, that of the lower heat-insulating layer was 8.0 g/m$^2$, that of the upper heat-insulating layer was 6.0 g/m$^2$, and that of the receiving layer was 2.5 g/m$^2$.

Subbing Layer Coating Liquid for Thermal Transfer Image-Receiving Sheet 1:

| | |
|---|---|
| Polyvinyl alcohol (Poval PVA205, trade name by Kuraray) | 7.5 mas. pts. |
| Styrene butadiene rubber latex (SN-307, trade name by Nippon A & L, solid content 48%) | 92.5 mas. pts. |

Under Heat-Insulating Layer Coating Liquid:

| | |
|---|---|
| Acrylic styrene hollow particles (Nippon Zeon's Nipol MH5055, having a mean particle size of 0.5 μm and a solid content of 30%) | 40 mas. pts. |
| Gelatin (aqueous 10% solution) | 60 mas. pts. |

Solid content by mass of hollow particles/solid content by mass of water-soluble polymer = 2.0.

Upper Heat-Insulating Layer Coating Liquid:

| | |
|---|---|
| Acrylic styrene hollow particles (Nipol MH5055, having a mean particle size of 0.5 μm and a solid content of 30%, by Nippon Zeon) | 61 mas. pts. |
| Gelatin (aqueous 10% solution) | 28 mas. pts. |
| Water | 11 mas. pts. |

Solid content by mass of hollow particles/solid content by mass of water-soluble polymer = 6.5.

Receiving Layer Coating Liquid 1:

| | |
|---|---|
| Receiving layer polymer 1 (shown above, vinylchloride 90 mol %) | 65 mas. pts. |
| Aqueous 10% gelatin solution | 16 mas. pts. |
| Water | 9 mas. pts. |
| Surfactant F-1 mentioned below (aqueous 5% solution) | 2 mas. pts. |
| Surfactant F-2 mentioned below (aqueous 5% solution) | 8 mas. pts. |
| NaOH | to make pH 8. |

(F-1)

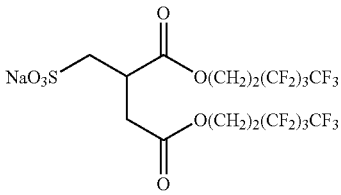

(F-2)

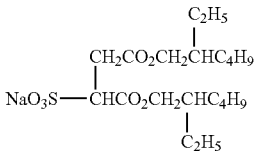

(Image Formation)

For image formation, FUJIFILM's Thermal Photoprinter ASK-2000L (trade name) was used. The above thermal transfer sheet 1 having a cyan part and a transferable protective layer laminate part, and the above thermal transfer image-receiving sheet were worked so that they could be charged in the printer, and a solid image having a highest cyan density was outputted on the image-receiving sheet in an environment at a temperature of 30° C. and a relative humidity of 80%.

The transferable protective layer laminate was transferred subsequently after the cyan part of the ink sheet was transferred.

(Evaluation of Relative Transfer Density)

The cyan density of the cyan solid image having the highest density that had been formed in image formation in Comparative Example 1 was measured with Xrite 310 (trade name by Xrite).

Based on the cyan density, 100, in Comparative Example 2 in which a thermal transfer sheet 1 and a thermal transfer image-receiving sheet 2 mentioned below were combined, the cyan density of the tested samples was expressed as a relative value. The results are shown in Table 2.

(Evaluation of Gloss)

In the above-mentioned environment, 100 copies with a cyan solid image thereon were continuously outputted, and checked visually for image gloss unevenness appearing thereon. The number of the copies having image gloss unevenness was counted.

The gloss unevenness appears in transferring the transferable protective layer laminate, and this is referred to as OP unevenness. The unevenness is problematic in water-based image-receiving sheets. The gloss unevenness detracts from the image quality of photographs, and therefore, the number of the copies having image gloss unevenness is preferably smaller.

The thermal transfer image-receiving sheet 1 and the thermal transfer sheet 1 mentioned above were combined, and tested for the transfer density and the frequency of gloss unevenness. The results are shown in Table 2.

Comparative Examples 2 to 7

Thermal transfer image-receiving sheets 2 to 7 were produced in the same manner as in Comparative Example 1, for which, however, the receiving layer coating liquid 1 used in producing the thermal transfer image-receiving sheet 1 was changed to receiving layer coating liquids 2 to 7.

Thus obtained, any of the thermal transfer image-receiving sheets 2 to 7 was combined with the above-mentioned thermal transfer sheet 1, and tested for image formation. These are Comparative Examples 2 to 7. The samples were evaluated in the same manner as in Comparative Example 1, and the results are shown in Table 2 below.

Receiving Layer Coating Liquid 2:

| | |
|---|---|
| Receiving layer polymer 1 (vinyl chloride 90 mol %) | 65 mas. pts. |
| Aqueous 10% gelatin solution | 16 mas. pts. |
| Fluorine-containing oligomer (DIC's Megafac F-472SF) | 1 mas. pt. |
| Water | 8 mas. pts. |
| Surfactant F-1 (aqueous 5% solution) | 2 mas. pts. |
| Surfactant F-2 (aqueous 5% solution) | 8 mas. pts. |
| NaOH | to make pH 8. |

Receiving Layer Coating Liquid 3:

| | |
|---|---|
| Receiving layer polymer 1 (vinyl chloride 90 mol %) | 56 mas. pts. |
| Aqueous 10% gelatin solution | 14 mas. pts. |
| Emulsion A mentioned below (KF-393) | 14 mas. pts. |
| Water | 7 mas. pts. |
| Surfactant F-1 (aqueous 5% solution) | 2 mas. pts. |
| Surfactant F-2 (aqueous 5% solution) | 7 mas. pts. |
| NaOH | to make pH 8. |

The emulsified dispersion A used in preparing the receiving layer coating liquid 3 was prepared as follows:

An antioxidant EB-9 (15.3 g) was dissolved in a high-boiling point solvent Solv-5 (12 g) and ethyl acetate (20 ml). An amino-modified silicone oil KF-393 (by Shin-etsu Chemical Industry) (38 g) was added to aqueous 20 mas. % gelatin solution (250 g) containing sodium dodecylbenzenesulfonate (1 g). These were emulsified and dispersed using a high-speed stirring emulsifier (dissolver), and water was added thereto to prepare the emulsion A (380 g).

Receiving Layer Coating Liquid 4:

| | |
|---|---|
| Receiving layer polymer 1 (vinyl chloride 90 mol %) | 65 mas. pts. |
| Aqueous 10% gelatin solution | 16 mas. pts. |
| Polyether-modified silicone (KF-352A, trade name by Shin-etsu Chemical Industry, falling within the scope of formula (3)) | 1 mas. pt. |
| Water | 8 mas. pts. |
| Surfactant F-1 (aqueous 5% solution) | 2 mas. pts. |
| Surfactant F-2 (aqueous 5% solution) | 8 mas. pts. |
| NaOH | to make pH 8. |

Receiving Layer Coating Liquid 5:

| | |
|---|---|
| Receiving layer polymer 2 (shown above, vinyl chloride 95 mol %) | 65 mas. pts. |
| Aqueous 10% gelatin solution | 16 mas. pts. |
| Polyether-modified silicone (KF-352A, trade name by Shin-etsu Chemical Industry, falling within the scope of formula (3)) | 1 mas. pt. |
| Water | 8 mas. pts. |
| Surfactant F-1 (aqueous 5% solution) | 2 mas. pts. |
| Surfactant F-2 (aqueous 5% solution) | 8 mas. pts. |
| NaOH | to make pH 8. |

Receiving Layer Coating Liquid 6:

| | |
|---|---|
| Receiving layer polymer 3 (shown above, vinyl chloride 97 mol %) | 65 mas. pts. |
| Aqueous 10% gelatin solution | 16 mas. pts. |
| Polyether-modified silicone (KF-352A, trade name by Shin-etsu Chemical Industry, falling within the scope of formula (3)) | 1 mas. pt. |
| Water | 8 mas. pts. |
| Surfactant F-1 (aqueous 5% solution) | 2 mas. pts. |
| Surfactant F-2 (aqueous 5% solution) | 8 mas. pts. |
| NaOH | to make pH 8. |

Receiving Layer Coating Liquid 7:

| | |
|---|---|
| Receiving layer polymer 4 (shown above, vinyl chloride 100 mol %) | 65 mas. pts. |
| Aqueous 10% gelatin solution | 16 mas. pts. |
| Polyether-modified silicone (KF-352A, trade name by Shin-etsu Chemical Industry, falling within the scope of formula (3)) | 1 mas. pt. |
| Water | 8 mas. pts. |
| Surfactant F-1 (aqueous 5% solution) | 2 mas. pts. |
| Surfactant F-2 (aqueous 5% solution) | 8 mas. pts. |
| NaOH | to make pH 8. |

Comparative Examples 8 to 10, and Examples 1 to 3

A thermal transfer sheet 2 was produced in the same manner as that for the thermal transfer sheet 1, for which, however, a subbing layer coating liquid for thermal transfer sheet 2 mentioned below was used in forming the subbing layer, and a cyan dye layer was formed on the subbing layer. The solid coating amount of the subbing layer was 0.12 g/m$^2$.

Thus obtained, the thermal transfer sheet 2 was combined with any of the above-mentioned thermal transfer image-receiving sheets 1 to 7, and tested for image formation. These are Comparative Examples 8 to 10 and Examples 1 to 3. The samples were evaluated in the same manner as in Comparative Example 1, and the results are shown in Table 2 below.

Subbing Layer Coating Liquid for Thermal Transfer Sheet 2:

| | |
|---|---|
| Tyzor TBT (tetra-n-butyl titanate, trade name by DuPont) | 26.3 mas. pts. |
| N-propyl acetate | 63.2 mas. pts. |
| N-butyl alcohol | 10.5 mas. pts. |

After the subbing layer was formed by coating, this was heated for polycondensation to form a titanium oxide film.

Example 4

A thermal transfer image-receiving sheet 8 was produced in the same manner as that for the thermal transfer image-receiving sheet 5 in Example 1, for which, however, the polyether-modified silicone in the receiving layer coating liquid 5 in Example 1 was changed to L-7001 (trade name by Toray Dow Corning Silicone, falling within the scope of formula (3)).

Thus obtained, the thermal transfer image-receiving sheet 8 was combined with the above-mentioned thermal transfer sheet 2, and tested for image formation. This is Example 4. The sample was evaluated in the same manner as in Comparative Example 1, and the results are shown in Table 2 below.

Examples 5 to 7

Thermal transfer image-receiving sheets 9 to 11 were produced in the same manner as in Example 1, for which, however, the polyether-modified silicone in the receiving layer coating liquid 5 used in the thermal transfer image-receiving sheet 5 in Example 1 was changed to KF-615A (trade name by Shin-etsu Chemical Industry, falling within the scope of formula (3)), KF-640 (trade name by Shin-etsu Chemical Industry, falling within the scope of formula (3)) or FZ-2208 (trade name by Toray Dow Corning Silicone, falling within the scope of formula (4)).

Thus obtained, any of the thermal transfer image-receiving sheets 9 to 11 was combined with the above-mentioned thermal transfer sheet 2, and tested for image formation. These are Examples 5 to 7. The samples were evaluated in the same manner as in Comparative Example 1, and the results are shown in Table 2 below.

Example 8 and Comparative Example 9

Thermal transfer sheets 3 and 4 were produced in the same manner as in Example 1, for which, however, Tyzor TBT (tetra-n-butyl titanate) in the subbing layer in the thermal transfer sheet 2 was changed to Tyzor TPT (tetra-isopropyl titanate, product name by DuPont) or tetra-n-butyl titanate dimer (product name by Mitsubishi Gas Chemical).

The thermal transfer image-receiving sheet 5 was combined with the thus-obtained thermal transfer sheet 3 or 4, and tested for image formation. These are Examples 8 and 9. The samples were evaluated in the same manner as in Comparative Example 1, and the results are shown in Table 2 below.

TABLE 2

| | Thermal Transfer Sheet | | Thermal Transfer Image-Receiving Sheet | | | Test Results | |
|---|---|---|---|---|---|---|---|
| | Number | Subbing Layer | Number | Proportion of Vinyl Chloride (mol %) | Additive | Relative Transfer Density | Number of Copies with gloss unevenness |
| Comp. Example 1 | 1 | no | 1 | 90 | no | — | — |
| Comp. Example 2 | 1 | no | 2 | 90 | F-472SF | 100 | 3 |
| Comp. Example 3 | 1 | no | 3 | 90 | KF393 | 100 | 2 |
| Comp. Example 4 | 1 | no | 4 | 90 | KF352A | 100 | 2 |
| Comp. Example 5 | 1 | no | 5 | 95 | KF352A | 102 | 4 |
| Comp. Example 6 | 1 | no | 6 | 97 | KF352A | 103 | 7 |
| Comp. Example 7 | 1 | no | 7 | 100 | KF352A | 103 | 10 |
| Comp. Example 8 | 2 | titanium oxide | 1 | 90 | no | — | — |
| Comp. Example 9 | 2 | titanium oxide | 2 | 90 | F-472SF | 112 | 58 |
| Comp. Example 10 | 2 | titanium oxide | 4 | 90 | KF352A | 113 | 32 |
| Example 1 | 2 | titanium oxide | 5 | 95 | KF352A | 130 | 4 |
| Example 2 | 2 | titanium oxide | 6 | 97 | KF352A | 135 | 1 |
| Example 3 | 2 | titanium oxide | 7 | 100 | KF352A | 140 | 2 |
| Example 4 | 2 | titanium oxide | 8 | 95 | L-7001 | 130 | 4 |
| Example 5 | 2 | titanium oxide | 9 | 95 | KF-615A | 129 | 5 |
| Example 6 | 2 | titanium oxide | 10 | 95 | KF-640 | 128 | 6 |
| Example 7 | 2 | titanium oxide | 11 | 95 | FZ-2208 | 131 | 5 |
| Example 8 | 3 | titanium oxide | 5 | 95 | KF352A | 125 | 4 |
| Example 9 | 4 | titanium oxide | 5 | 95 | KF352A | 123 | 4 |

In Table 2 above, in Comparative Examples 1 to 7 with "no" subbing layer, a subbing layer was not formed but the dye layer was formed by coating directly on the easy adhesion-treated surface of the substrate film.

Comparative Example 3 corresponds to an embodiment of the image-receiving sheet described in JP-A 2008-6781 referred to in the section of "Background Art"; and Comparative Example 8 corresponds to a thermal transfer sheet having a subbing layer described in JP-A 63-135288.

From Table 2 above, it is known that the samples of Examples 1 to 3 of the invention all had a high transfer density and solved the problem of image gloss unevenness.

In Comparative Examples 1 and 8, the image density was immeasurable owing to peeling failure. In Comparative Examples 9 and 10, an additive except polyether-modified silicone was combined with a subbing layer of titanium oxide, and the samples had noticeable image gloss unevenness.

Example 10

A thermal transfer image-receiving sheet 12 was produced like in Example 1, for which, however, the production method for the thermal transfer image-receiving sheet 5 was changed to the following production method.

The surface of a paper support double-laminated with polyethylene was processed for corona discharge treatment, and then a sodium dodecylbenzenesulfonate-containing gelatin undercoat layer was formed on it. On this, a subbing layer, a heat-insulating layer, an interlayer and a receiving layer (receiving layer coating liquid 12 mentioned below) were laminated by coating in that order from the side of the support through the simultaneous multilayer coating method illustrated in FIG. 9 in U.S. Pat. No. 2,761,791. The dry coating amount of the subbing layer was 3 g/m$^2$, that of the heat-insulating layer was 15 g/m$^2$, that of the interlayer was 2.5 g/m$^2$, and that of the receiving layer was 2.5 g/m$^2$.

Receiving Layer Coating Liquid 12:

| | |
|---|---|
| Receiving Layer Polymer 2 (shown above, vinyl chloride 95 mol %) | 20.0 mas. pts. |
| Vinyl chloride-based latex (Vinybran 690, by Nisshin Chemical Industry, having a solid concentration of 55% by mass, vinyl chloride 80 mol %) | 20.0 mas. pts. |
| Gelatin (aqueous 10% solution) | 2.0 mas. pts. |
| Polyvinyl pyrrolidone (K-90, trade name by ISP) | 0.5 mas. pts. |
| Polyether-modified silicone (L-7001, trade name by Toray Dow Corning Silicone, falling within the scope of formula (3)) | 1.0 mas. pt. |
| Surfactant F-1 (aqueous 5% solution) | 1.5 mas. pts. |
| Surfactant F-2 (aqueous 5% solution) | 5.0 mas. pts. |
| Water | 50.0 mas. pts. |

Interlayer Coating Liquid:

| | |
|---|---|
| Vinyl chloride-based latex (Vinybran 690, by Nisshin Chemical Industry, having a solid content of 55%, proportion of vinyl chloride 80%) | 50.0 mas. pts. |
| Gelatin (aqueous 10% solution) | 30.0 mas. pts. |
| Water | 20.0 mas. pts. |

Heat-Insulating Layer Coating Liquid:

| | |
|---|---|
| Acrylic hollow particles (Rohpake HP-1055, by Rohm & Haas, having a mean particle size of 1.0 μm, a solid concentration of 26.5% by mass and a degree of hollowness of 55%) | 20.0 mas. pts. |
| Acrylic styrene hollow particles (Nipol MH5055, by Nippon Zeon, having a mean particle size of 0.5 μm, a solid concentration of 30% by mass) | 3.0 mas. pts. |
| Gelatin (aqueous 10% solution) | 25.0 mas. pts. |
| Styrene-butadiene latex (Nipol 2507H, by Nippon Zeon, having Tg = 58° C., a mean particle size of 250 nm and a solid concentration of 52% by mass) | 4.8 mas. pts. |
| Water | 47.2 mas. pts. |

Subbing Layer Coating Liquid:

| | |
|---|---|
| Polyvinyl alcohol (Poval PVA205, trade name by Kuraray) | 5.0 mas. pts. |
| Styrene-butadiene rubber latex (SN-307, trade name by Nippon A & L, having a solid concentration of 48% by mass) | 60.0 mas. pts. |
| Water | 35.0 mas. pts. |

The above-mentioned thermal transfer sheet 2 was combined with the thus-obtained thermal transfer image-receiving sheet 12, and tested for image formation. This is Example 10. The sample was evaluated in the same manner as in Comparative Example 1, and the results are shown in Table 3 below.

TABLE 3

| | Thermal Transfer Sheet | | Thermal Transfer Image-Receiving Sheet | | | Test Results | |
|---|---|---|---|---|---|---|---|
| | Number | Subbing Layer | Number | Proportion of Vinyl Chloride (mol %) | Additive | Relative Transfer Density | Number of Copies with gloss unevenness |
| Example 10 | 2 | titanium oxide | 12 | 95 | L-7001 | 132 | 4 |

From the results in Table 3, it is known that the sample of the invention had a high transfer density and solved the problem of image gloss unevenness.

While the present invention has been described in detail and with reference to specific embodiments thereof, it will be apparent to one skilled in the art that various changes and modifications can be made therein without departing from the spirit and scope thereof.

The present disclosure relates to the subject matter contained in Japanese Patent Application No. 2009-082098, filed on Mar. 30, 2009, the contents of which are expressly incorporated herein by reference in their entirety. All the publications referred to in the present specification are also expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A method of image formation comprising:

putting a thermal transfer sheet and a thermal transfer image-receiving sheet one upon another in such a manner that a dye layer of the thermal transfer sheet is kept in contact with a receiving layer of the thermal transfer image-receiving sheet, wherein the thermal transfer sheet has at least one subbing layer of a titanium oxide film on a substrate film, having the dye layer on a part of the subbing layer and having a transferable protective layer laminate on the other part of the subbing layer than the part for the dye layer thereon, and wherein the thermal transfer image-receiving sheet has, on a support, at least one receiving layer containing a polymer latex, in which vinyl chloride is polymerized in at least 95 mol % of all the polymerization monomers, and a polyether-modified silicone, and having at least one heat-insulating layer;

recording an image on the receiving layer by a heating device; and transferring at least a part of the transferable protective layer laminate onto the receiving layer by the heating device.

2. The method of image formation according to claim 1, wherein the polymer latex in which vinyl chloride is polymerized in at least 95 mol % of all the polymerization monomers is a copolymer latex of vinyl chloride and at least one monomer selected from vinyl acetate, acrylic acid, acrylates, methacrylic acid and methacrylates, or a vinyl chloride homopolymer latex.

3. The method of image formation according to claim 1, wherein the polymer latex in which vinyl chloride is polymerized in at least 95 mol % of all the polymerization monomers is a copolymer latex of vinyl chloride and at least one monomer selected from acrylates and methacrylates.

4. The method of image formation according to claim 3, wherein the acrylates have an alkyl group having from 1 to 10 carbon atoms and the methacrylates have an alkyl group having from 1 to 10 carbon atoms.

5. The method of image formation according to claim 1, wherein the polymer latex in which vinyl chloride is polymerized in at least 95 mol % of all the polymerization monomers has a mean particle size of from 10 to 1000 nm.

6. The method of image formation according to claim 1, wherein the polymer latex in which vinyl chloride is polymerized in at least 95 mol % of all the polymerization monomers has a glass transition temperature of from −30° C. to 100° C.

7. The method of image formation according to claim 1, wherein the polyether-modified silicone is liquid at 25° C.

8. The method of image formation according to claim 1, wherein the polyether-modified silicone is represented by one of the following formulae (1) to (4):

Formula (1)

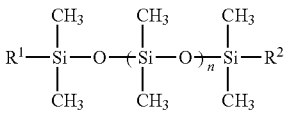

Formula (2)

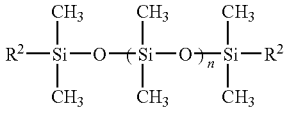

-continued

Formula (3)

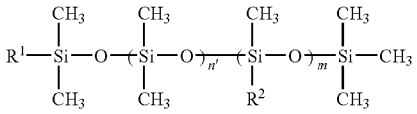

Formula (4)

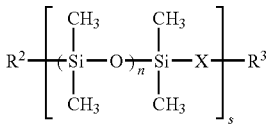

wherein $R^1$ represents an alkyl group; $R^2$ each independently represents —Y—$(C_2H_4O)_a$—$(C_3H_6O)_b$—$R^4$; $R^3$ represents a hydrogen atom, an acyl group having at least one acyl moiety, an at least monovalent alkyl group, an at least monovalent cycloalkyl group, or an at least monovalent aryl group; $R^4$ each independently represents a hydrogen atom, an acyl group, an alkyl group, a cycloalkyl group or an aryl group; Y represents a single bond or a divalent linking group; X represents a divalent linking group; n indicates a positive number; n' indicates 0 or a positive integer; m indicates 0 or a positive number; s indicates a positive number; a and b each independently indicate 0 or a positive number, provided that a and b are not 0 at the same time; and n' and m are not 0 at the same time.

9. The method of image formation according to claim 8, wherein the polyether-modified silicone is represented by the formula (2).

10. The method of image formation according to claim 8, wherein the polyether-modified silicone is represented by the formula (3).

11. The method of image formation according to claim 8, wherein the polyether-modified silicone is represented by the formula (4).

12. The method of image formation according to claim 1, wherein the polyether-modified silicone has an HLB value of from 5 to 9.

13. The method of image formation according to claim 1, wherein the amount of the polyether-modified silicone is from 1% to 20% by mass relative to the total polymer latex in the receiving layer.

14. The method of image formation according to claim 1, wherein at least one of the receiving layer and the heat-insulating layer contains gelatin.

15. The method of image formation according to claim 1, wherein the heat-insulating layer contains hollow polymeric particles.

16. The method of image formation according to claim 1, wherein the titanium oxide film is a polycondensation product of a titanium alkoxide or its hydrolyzate.

17. The method of image formation according to claim 1, wherein the solid content of the subbing layer is in the range of from 0.01 g/m$^2$ to 0.20.

18. The method of image formation according to claim 1, wherein the transferable protective layer laminate is composed of a lubricant layer, a protective layer and an adhesive layer.

19. The method of image formation according to claim 18, wherein the protective layer and the adhesive layer are transferred onto the receiving layer by the heating device.

20. The method of image formation according to claim 1, wherein at least a part of the transferable protective layer laminate is transferred onto the receiving layer after the image is recorded on the receiving layer.

* * * * *